US006681932B2

(12) United States Patent
Bradfield

(10) Patent No.: US 6,681,932 B2
(45) Date of Patent: Jan. 27, 2004

(54) DISPLAY HANGER

(75) Inventor: Iain Bradfield, Staffordshire (GB)

(73) Assignee: Plasplugs Limited, Staffordshire (GB)

( * ) Notice: Subject to any disclaimer, the term of this patent is extended or adjusted under 35 U.S.C. 154(b) by 21 days.

(21) Appl. No.: 09/927,021

(22) Filed: Aug. 9, 2001

(65) Prior Publication Data

US 2002/0063073 A1 May 30, 2002

(30) Foreign Application Priority Data

Aug. 10, 2000 (GB) ..... 0019540

(51) Int. Cl.[7] ..... A45C 11/26
(52) U.S. Cl. ..... 206/349; 206/482; 206/806
(58) Field of Search ..... 206/349, 45.2, 206/45.23, 45.28, 756, 759, 745, 747, 749, 461, 470, 471, 493, 477, 478, 480–482, 736, 767, 806; 211/60.1, 70.6; 224/901, 901.2, 901.4, 901.6, 901.8

(56) References Cited

U.S. PATENT DOCUMENTS 4,069,915 A * 1/1978 Schurman ..... 206/349
4,714,159 A * 12/1987 Linden ..... 206/349
4,899,882 A 2/1990 Benner
5,372,249 A * 12/1994 Grange ..... 206/45.23
5,477,964 A * 12/1995 Hart ..... 206/349
6,076,669 A 6/2000 Ling
6,186,323 B1 * 2/2001 Jansson et al. ..... 206/349

FOREIGN PATENT DOCUMENTS

WO WO 00/09412 2/2000

* cited by examiner

*Primary Examiner*—Luan K. Bui
(74) *Attorney, Agent, or Firm*—Nikolai & Mersereau, P.A.

(57) ABSTRACT

A display hanger for an article, the hanger including a planar support body adapted for suspension from a support, a container into which at least a portion of the article may be inserted, the container being movably connected to said planar support so as to be movable between a display position and a utility position, the container when in its display position being arranged in a downwardly facing orientation to locate an article inserted therein so as to depend downwardly from the support body when the support body is suspended from said support, the container when it its utility position being supported by said support body in an upwardly facing orientation so as to define a storage container into which the article may be inserted for storage when not in use.

5 Claims, 10 Drawing Sheets

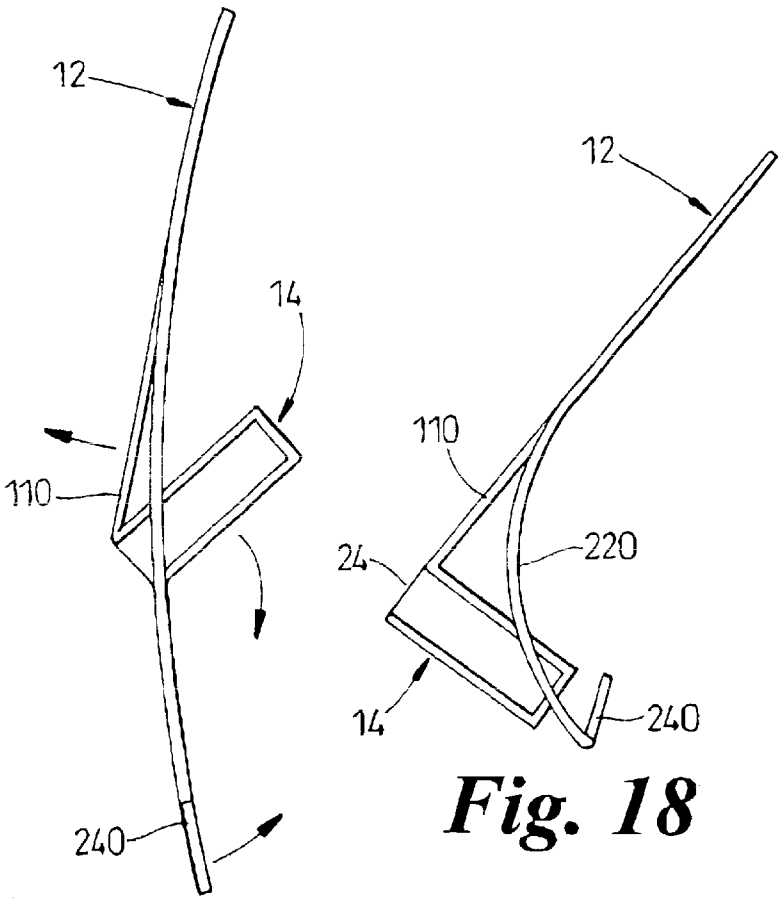
Fig. 17
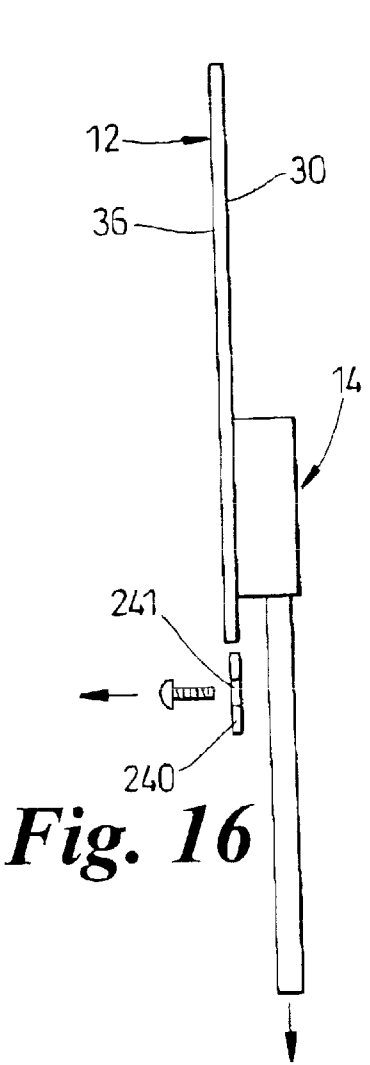
Fig. 16
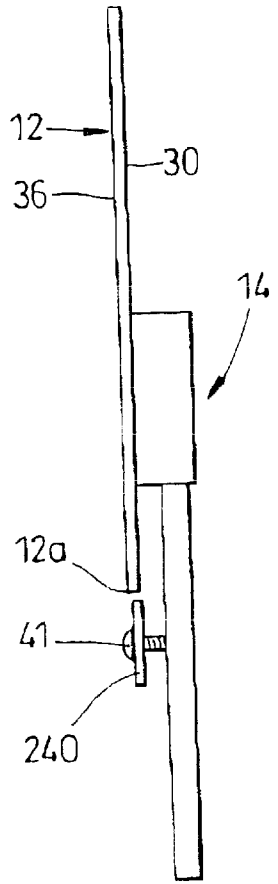
Fig. 15
Fig. 18

DISPLAY HANGER

The present invention relates to a display hanger for a article, preferably an elongate article, in particular, but not exclusively, a utility knife.

It is common practice to package articles on hangers formed of card or hangers which encapsulate the article in plastics film (blister packs). Once the article has been removed from its package by a purchaser, the package serves no purpose and is discarded.

This is highly disadvantageous as it is wasteful in the use of materials and creates environmental problems for the disposal of waste materials.

A general aim of the present invention is to provide a display hanger for an elongate article which is convertible from a display mode to a utility mode so that the hanger performs a useful alternative purpose for the purchaser after removal of the article from the hanger and so obviates the need to dispose of the hanger.

According to one aspect of the present invention there is provided a display hanger for an article, the hanger including a planar support body adapted for suspension from a support, a container into which at least a portion of the article may be inserted, the container being movably connected to said planar support so as to be movable between a display position and a utility position, the container when in its display position being arranged in a downwardly facing orientation to locate an article inserted therein so as to depend downwardly from the support body when the support body is suspended from said support, the container when it its utility position being supported by said support body in an upwardly facing orientation so as to define a storage container into which the article may be inserted for storage when not in use.

Preferably the support body and container are moulded in one piece from a suitable plastics material.

Various aspects of the present invention are hereinafter described with reference to the accompanying drawings, in which:

FIGS. 15 to 18 are side views of the third embodiment showing, in stages, conversion from its display mode to its utility mode.

Figure 1:
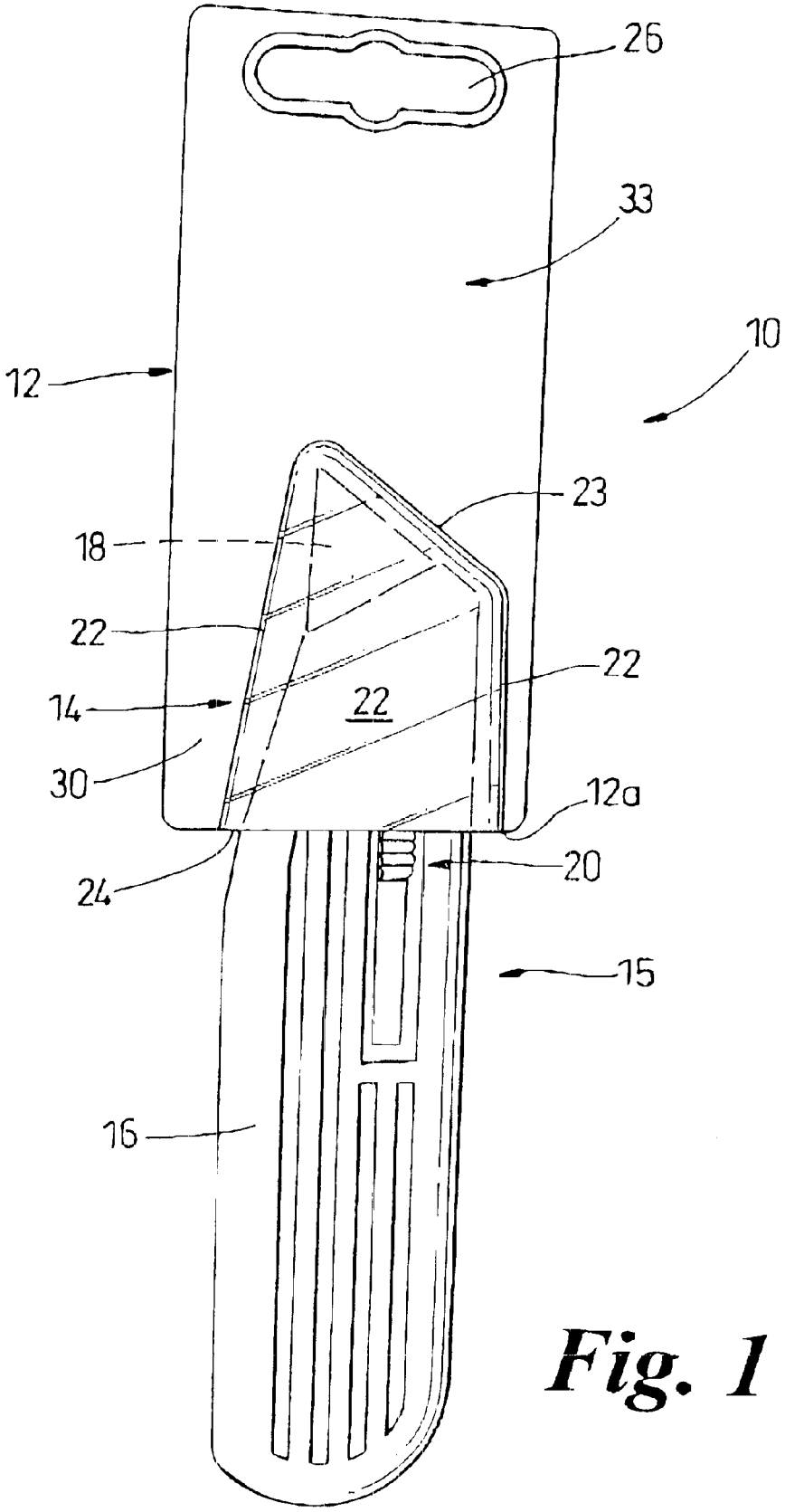
FIG. 1 is a front view of a hanger according to a first embodiment of the invention shown in its display mode.
Figure 2:
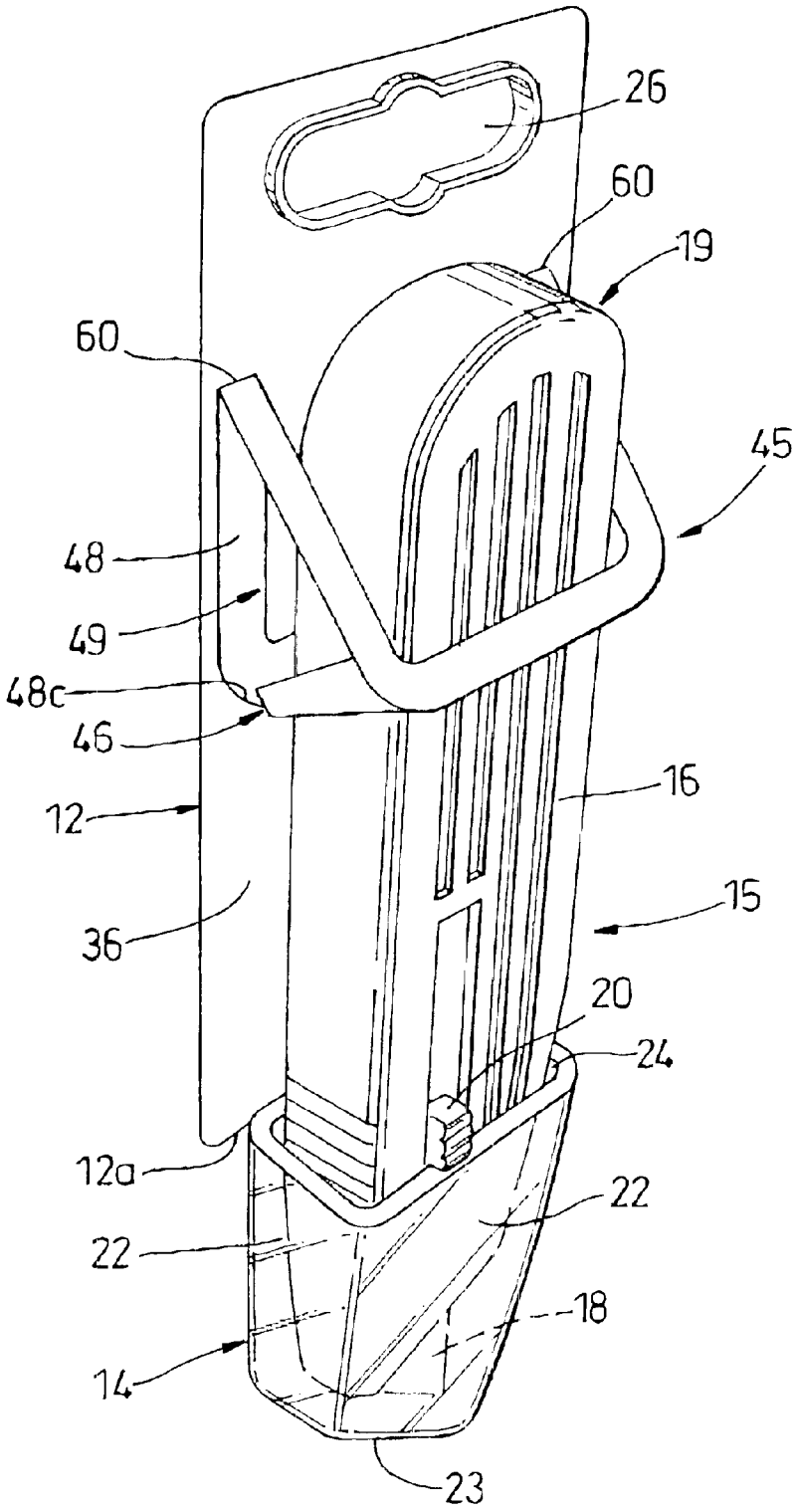
FIG. 2 is a perspective view of the first embodiment shown in its utility mode.

Referring initially to FIGS. 1 and 2, there is shown a hanger 10 according to a first embodiment of the present invention. The hanger 10 includes a planar support body 12 and a container 14 and is preferably in the form of a one piece plastics moulding formed, preferably by injection moulding, from a suitable resilient plastics material such as polypropylene.

In the illustrated embodiment, the hanger 10 is intended to display at a point of sale an elongate article in the form of a knife 15 having a handle 16 from the head end 17 of which extends a retractable blade 18. An operating mechanism 20 for retracting/projecting the blade 18 is provided at the side of the knife handle 16.

The container 14 preferably comprises a hollow housing having sides 22 and a bottom 23. The housing has an open top 24 through which the head end 17 of the handle 16 may be inserted into and removed from the housing.

The container 14 is movably mounted on the support body 12 for movement between a display position (as shown in FIG. 1) and a utility position (as shown in FIG. 2) to thereby convert the hanger from its display mode to its utility mode.

Preferably as shown in FIG. 1, the support body 12 is provided with a slot 26 adjacent to its upper end to enable the hanger 10 to be suspended from a display rail in a known manner. Provision of slot 26 as a means for suspension is preferred but it will be appreciated that other means of suspension may be provided if desired, eg. a hook.

Preferably as shown in FIG. 1, when the container 14 is in its display position, it overlies the lower region of the front face 30 of the support body 12 with its open top 24 facing downwardly.

Accordingly the container 14 positively locates the head of the knife 15 such that the knife handle 16 depends downwardly from the support body 12 and beyond the lower edge 12*a* of the support body 12. This is advantageous as it enables a prospective purchaser to test the knife by gripping the handle 16 and operating the operating mechanism 20 whilst at the same time fully shielding the blade 18. In addition, since the container 14 only covers the lower region of the support body 12, a relatively large display area 33 is provided for carrying labels/printing displaying information, logos etc.

Retention means, preferably in the form of a screw 41 (FIG. 3) is provided for preventing withdrawal of the knife 15 from the container 14 when in its display position. By preventing withdrawal of the knife 15 from the container 14, the container 14 is also prevented from moving to its utility position and so the hanger 10 is fixedly maintained in its display mode.

As shown in FIG. 2, when the container 14 has been moved to its utility position, the open top 24 faces upwardly toward the suspension end of the support body 12 and the container 14 now is preferably located beyond the lower edge 12*a* of the support body 12. The head of the knife 15 when inserted into the container 14 is now located lowermost with the handle 16 extending upwardly from the container 14 to overlie the rear face 36 of the support body 12.

In order to provide positive location for the tail end 19 of the handle 16 a looped strap 45 of generally U-shaped for is provided.

Preferably the strap 45 is integrally formed with the support body 12 and lies co-planar with the remainder of the support body 12 when the hanger 10 is in its display mode. The ends of the strap 45 are preferably connected to the remainder of the support body 12 by hinges 60.

When the strap 45 is moved to the position shown in FIG. 2, it creates a similarly shaped slot 48 which defines a downwardly facing tongue 49. The tongue 49 is used as a suspension means, for example by insertion into a pocket or belt of the purchaser in order to enable the support body to be suspended from a garment or belt.

Preferably the strap 45 is provided with spacer legs 46 which engage with the support body 12 in order to hold the strap 45 in the position shown in FIG. 2; the spacer legs 46 being held against the support body 12 by the inherent resilience of the plastic material.

Figure 6:
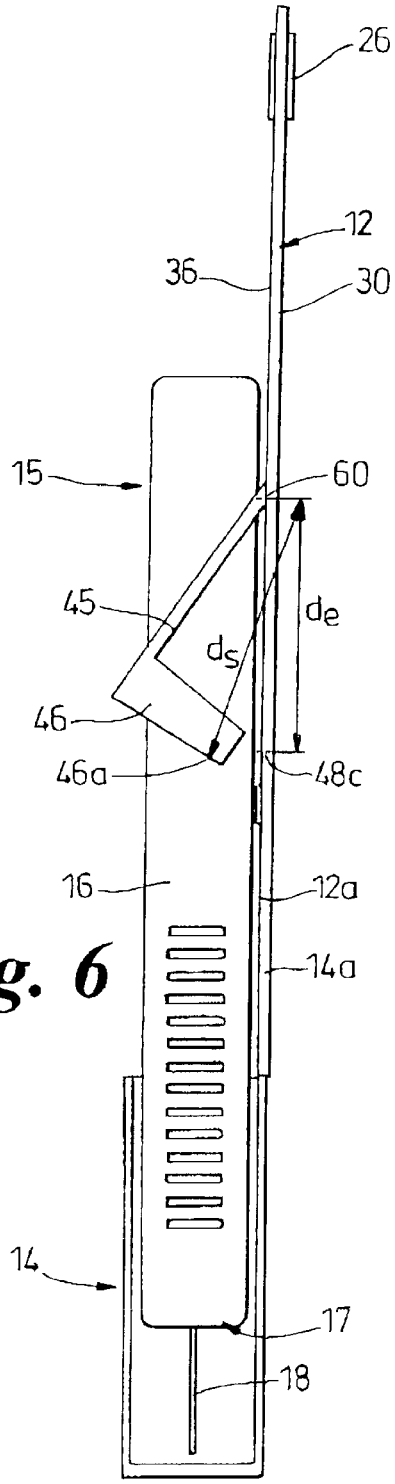
Figure 7:
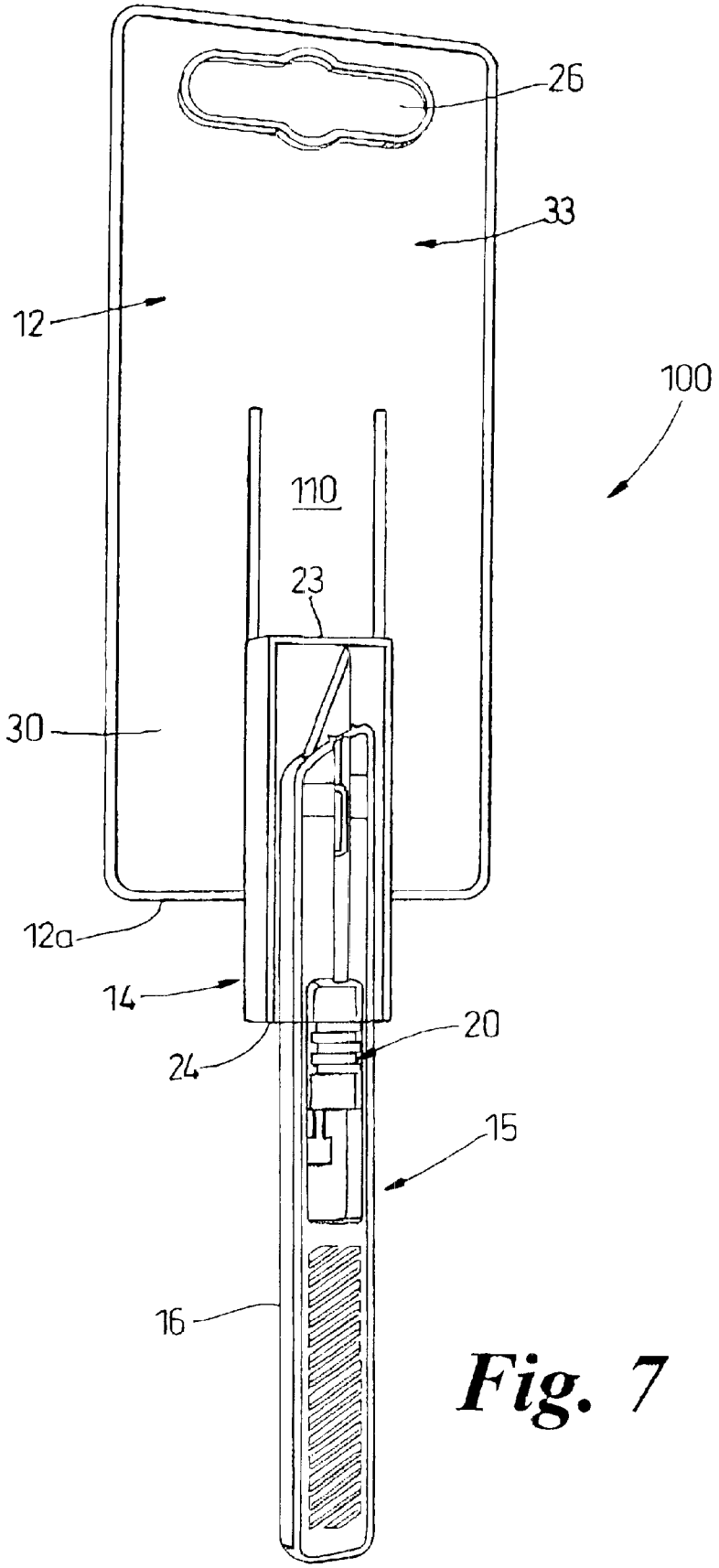
FIG. 7 is a perspective view of a second embodiment according to the present invention shown in its display mode.

To achieve abutment between the spacer legs 46 and the support body 12, the spacer legs 46 are each formed such that the distance $d_s > d_e$ where $d_s$ is the distance from hinge 60 to the lowermost edge 46*a* at the terminal end 47 of the spacer leg; and $d_e$ is the distance between hinge 60 and the lower edge 48*c* of slot 48 (FIG. 6). Accordingly when the strap 45 is moved to the position shown in FIG. 2, the lowermost edge 46*a* of each spacer leg 46 will engage the edge 48*c* of slot 48 and cause leg 46 to resiliently deflect. When completely through the slot 48, the legs 46 return to their undeflected positions and thereby enable the terminal ends 47 to engage against the rear face of the support body.

The container 14 may be directly or indirectly hingedly connected to the support body 12 by hinges formed during the moulding process. In this respect in FIGS. 1 and 2 the container 14 is illustrated as being directly hingedly connected to the lower edge 12*a* of the support body 12. Alternatively, as illustrated in FIGS. 3 to 6, the container 14 may be indirectly hingedly connected to the lower edge 12*a* via an intermediate flap 14*a*.

Conversion of the hanger 10 from its display position to its utility position is illustrated in FIGS. 3 to 6.

Figure 3:
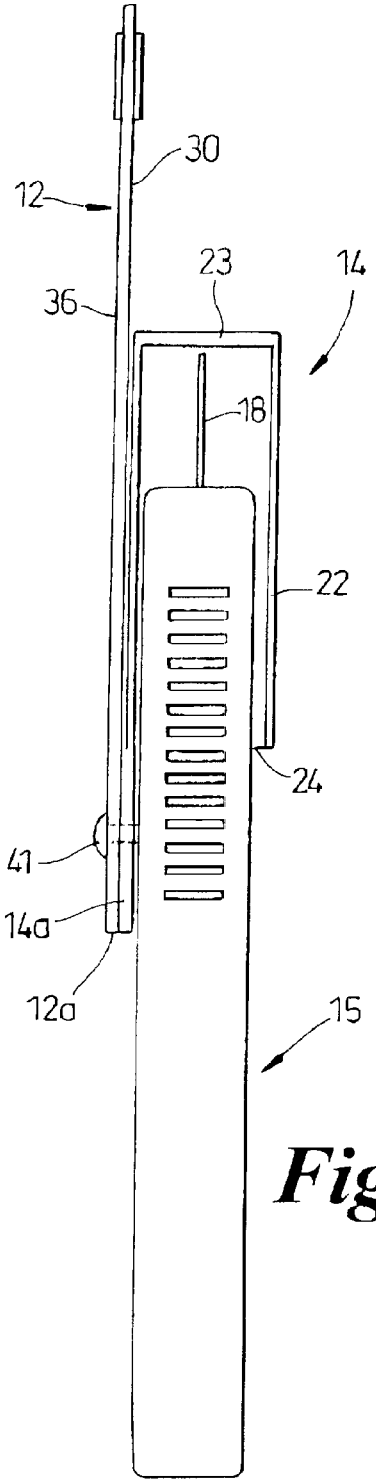
FIGS. 3 to 6 are side views of the first embodiment showing, in stages, conversion from its display mode to its utility mode.
Figure 4:
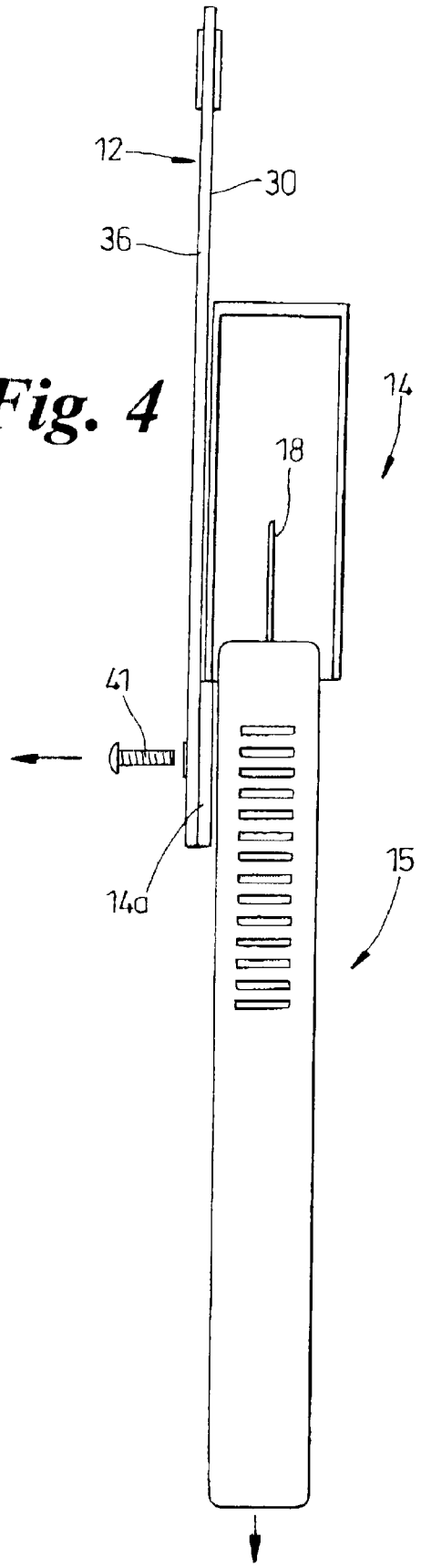
Figure 5:
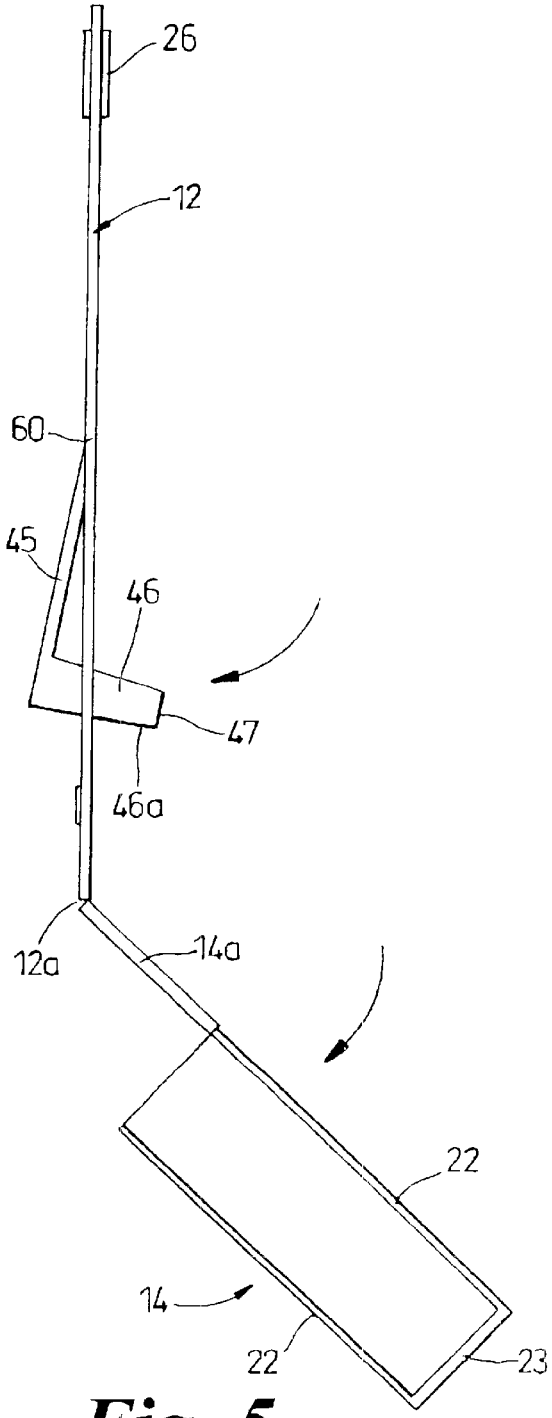

In FIG. 3 the hanger is shown in its display position with the knife 15 being prevented from withdrawal by screw 41. In FIG. 4, screw 41 is shown as being removed enabling the knife 15 to be withdrawn. In FIG. 5, the container 14 is hingedly moved away from the front face 30 towards its position where it resides below the lowermost edge 12*a* of the support body 12. The strap 45 is pushed out of the support body 12 to reside on the rear side of the support body 12 and to bring the spacer legs 46 into engagement with the rear face 36 of the support body 12, thereby holding the strap 45 open to receive the knife 15.

In FIG. 6, the knife 15 has been inserted through the straps 45 and into the container 14.

The support 12 may now be attached to a garment or belt of a purchaser by use of tongue 49 and thereby enable the support 12 to act as a holster.

A hinge 100 according to a second embodiment is illustrated in FIGS. 7 to 12 wherein parts similar to those shown in FIGS. 1 to 6 have been designated by the same reference numerals.

The hanger 100 is intended to be converted from its display mode (FIG. 7) to its utility mode (FIG. 8) whereby it is able to function as a table-top storage receptacle for the knife 15.

Figure 8:
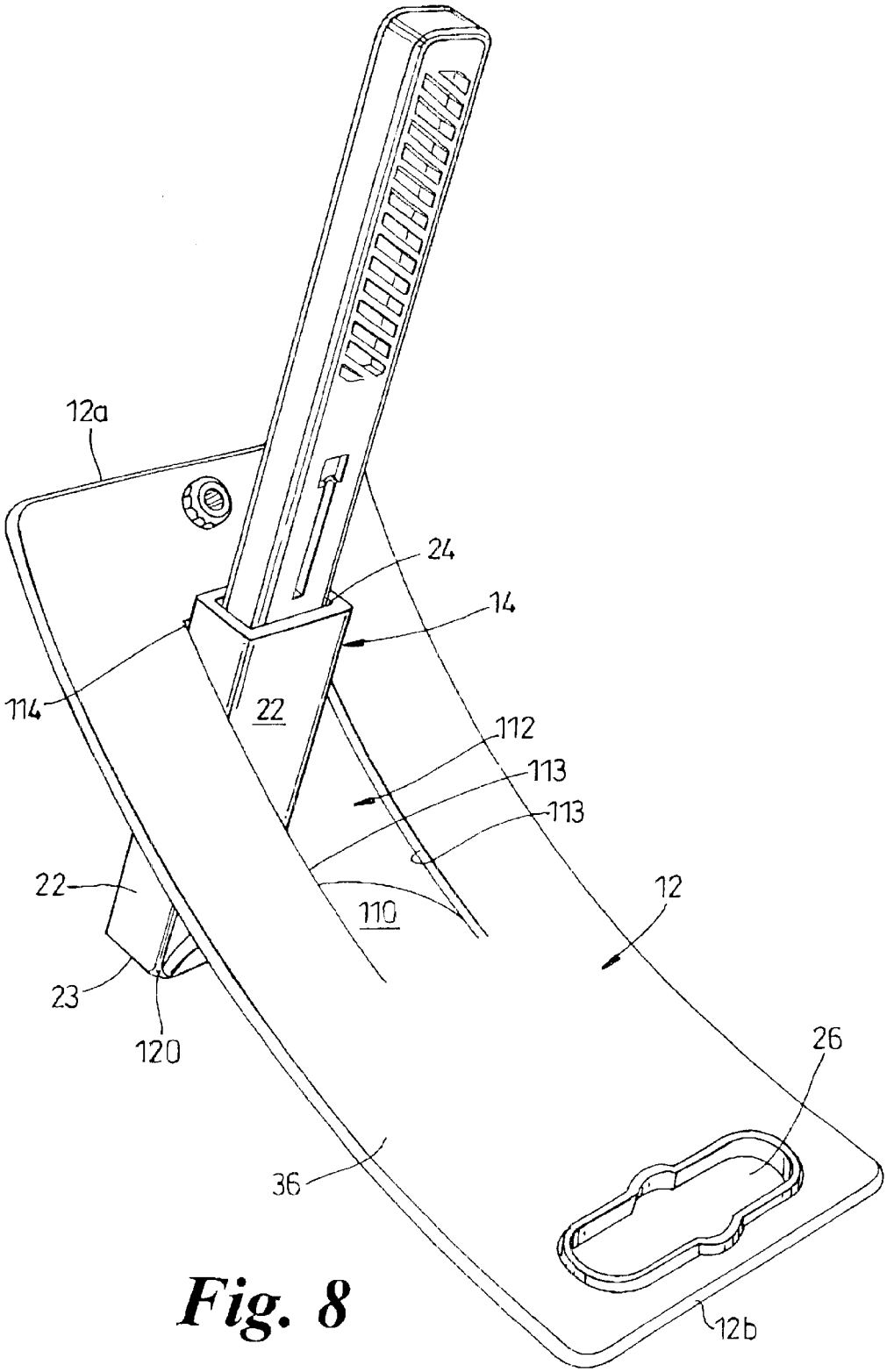
FIG. 8 is a perspective view of the second embodiment shown in its utility mode.

In hanger 100, the container 14 is hingedly connected via a hinge 120 located adjacent its bottom 23 to a tongue 110 formed within the support body 12. As seen in FIG. 8, when deflected, the tongue 110 creates an opening 112 in the support body 12 defined by a pair of opposed sides 113 and an end 114.

Figure 9:
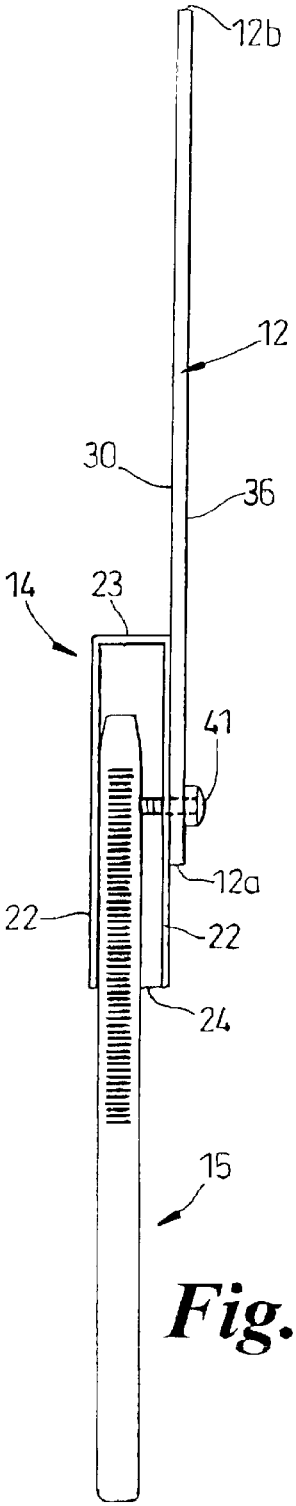
FIGS. 9 to 12 are side views of the second embodiment showing, in stages, conversion from its display mode to its utility mode.

In the display mode, the container 14 resides in face to face contact with the front face 30 of the support body 12 with the screw 41 passing through both the support body 12 and container 14 to engage the knife 15 (more clearly seen in FIG. 9).

In the utility mode (FIG. 8) the container 14 is positioned such that it projects through the opening 112 with its open top 24 oriented upwardly from the rear face 36 of the support body 12.

The container 14 abuts against the front face 30 of the support body adjacent to opening end 114 and due to the resilience of the plastics material, is held in position by being placed in compression due to deflection of the body 12 and tongue 110. Accordingly hanger 100 is maintained in its utility mode by virtue of the resilient interaction between tongue 110 and body 12 acting through container 14. In the utility mode, the body 12 is inclined upwardly from its upper edge 12*b* (when suspended in the display mode) such that the bottom 23 of the container 15 and the support body 12 adjacent the upper edge 12*b* define feet for supporting the hanger (in its utility mode) on a flat surface such as a table top.

In the utility mode, it is therefore possible to store the knife 15 conveniently on a table-top in readiness for use.

Conversion of the hanger 100 from its display mode to its utility mode is illustrated in FIGS. 9 to 12.

In FIG. 9, the hanger 100 is shown in its display mode wherein screw 41 retains the container 14 in its display position and prevents knife 15 from being withdrawn.

Figure 10:
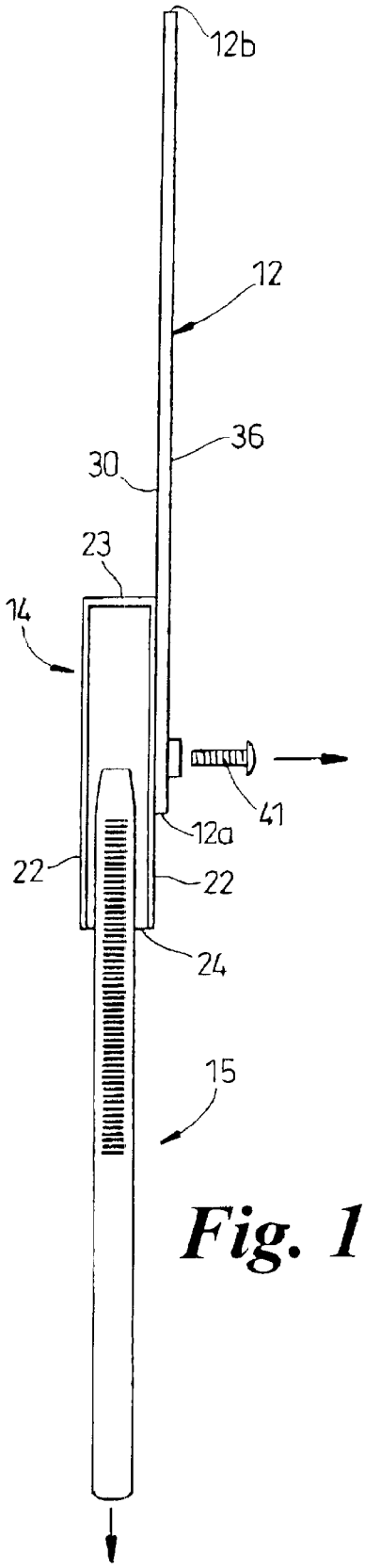

In FIG. 10, the screw 41 is removed enabling withdrawal of the knife 15.

Figure 11:
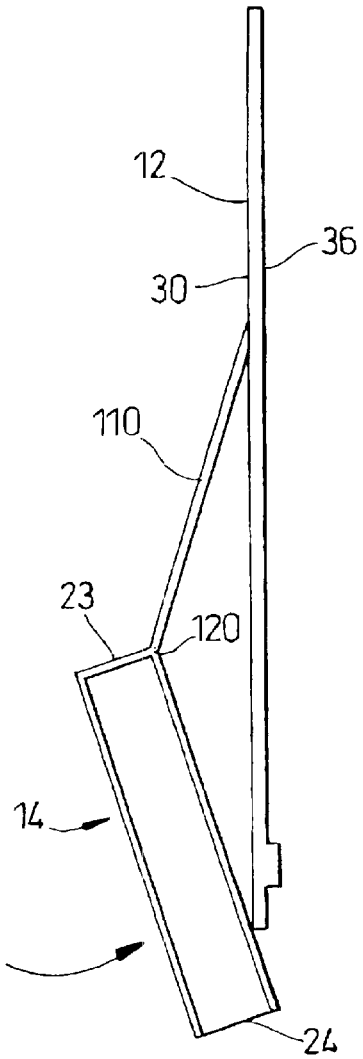

In FIG. 11, the container 14 is moved upwardly toward upper edge 12*b* whilst at the same time rotating the container 14 about its hinge 120 and deflecting tongue 110 forwardly of the support body 12.

Figure 12:
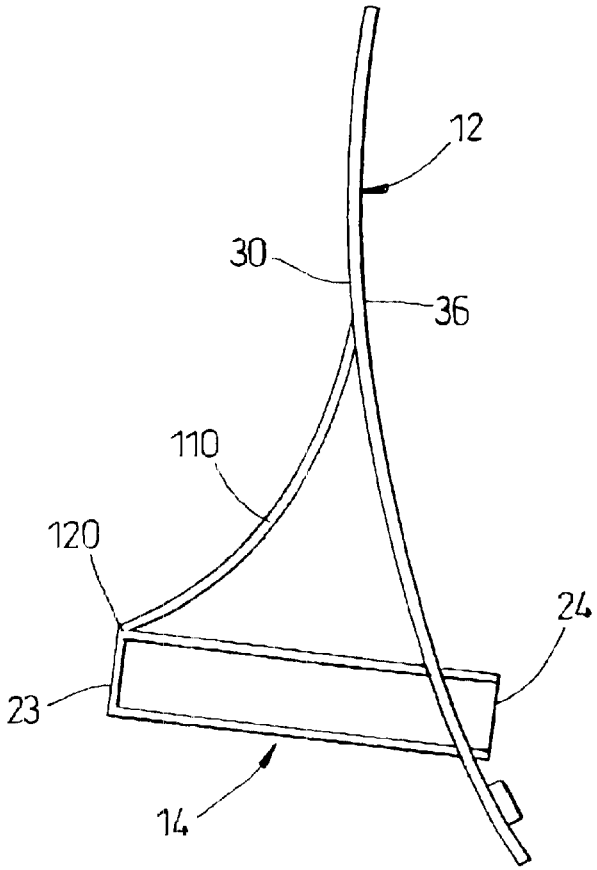

In FIG. 12, the container 14 has been positioned with its top end 24 in engagement with the opening end 114. The hanger 100 may now be placed upon a flat surface with bottom 23 of the container and the end face of support 12 adjacent edge 12*b* in contact therewith. Knife 15 may now be inserted and removed from the container.

A hanger 200 according to a third embodiment is illustrated in FIGS. 13 to 18 wherein parts similar to those in the first and second embodiments have been designated by the same reference numerals.

In hanger 200 the container 14 is hingedly connection to tongue 110 via a hinge 210 located adjacent to the top 24 of the container.

In the utility mode of hanger 200 (FIG. 14) the bottom 23 of the container 14 engages with the opening end 114 in order to maintain the hanger 200 in the utility mode.

Figure 14:
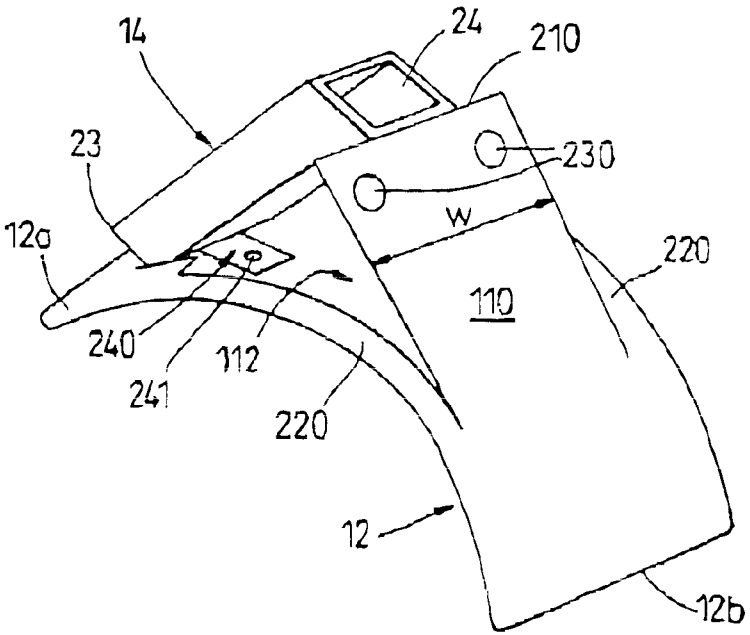
FIG. 14 is a front perspective view of the third embodiment shown in its utility mode.
Figure 13:
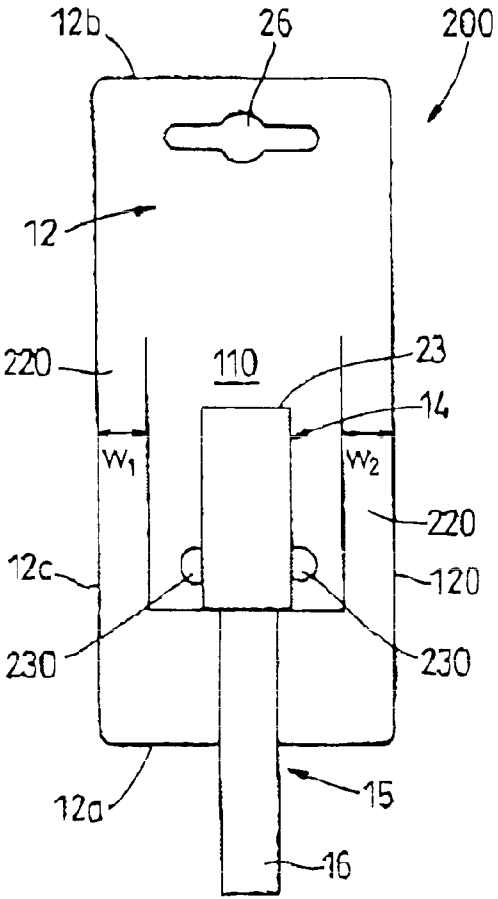
FIG. 13 is a front view of a third embodiment according to the present invention shown in its display mode.

Preferably as shown, the tongue 110 is substantially broader in hanger 200 so as to have a width W which is greater than the combined width ($W_1$ $W_2$) of the strips 220 of the support body 12 defined between opening sides 113 and the adjacent sides 12*c* of the support body 12. This causes the body 12 to resiliently deflect in preference to the tongue 110 and so as shown in FIG. 14, the body 23 is curved and the tongue 110 is substantially planar.

By curving the body 12, its lower and upper edges 12*a*, 12*b* define feet for supporting the hanger 200 (in utility mode) on a support surface such as a table-top.

Preferably the tongue 110 is provided with one or more apertures 230 which enable other elongate articles, such as for example pens or pencils to be stored in the hanger 200.

Preferably a retention flap 240 is hingedly connected to the lower edge 12*a* of the support body 12 and, when in its display mode, depends downwardly from the support body to receive screw 41 for preventing withdrawal of the knife 15 from the container 14.

In the utility mode of hanger 200, flap 240 is located beneath the container to project forwardly. The bore 241 which previously accommodated screw 41 may now function as a retention recess for locating the bottom end of a pen or pencil projecting through apertures 230.

The flap 240 may be provided with additional retention recesses corresponding to the number of apertures 230.

Conversion of hanger 200 from its display mode to its utility mode is illustrated in FIGS. 15 to 18.

In FIG. 15 screw 41 passes through flap 240 to engage knife 15 and so prevent it from being withdrawn from container 14.

In FIG. 16 screw 41 is removed permitting withdrawal of knife 15.

In FIG. 17, tongue 110 and the lower part of body 23 are moved in opposite directions (tongue 110 moving in the rearwards direction) and the container 14 is rotated about hinge 210. Flap 240 is moved in the forwards direction of the support body 12.

In FIG. 18, the lower part of container 14 has been moved into opening 112 with the bottom 23 of container engaged with the opening end 114.

In the embodiments described above, when the hanger is in its utility mode, the rear face 36 of the support body is visible in use. Conveniently the rear face 36 may be printed or carry a label in order to provide the user with an aesthetically pleasing design and/or useful information eg. measurement conversion tables, calendar, etc.

In the specific examples described above, the elongate article comprises a knife; it will however be appreciated that the invention is also applicable to other types of elongate articles, eg pens, tools, or articles which are not elongate.

What is claimed is:

1. A display hanger for an article, the hanger including a planar support body adapted for suspension from a support, a container having a hollow housing with sides, a bottom and an open top, the housing hingedly connected to said planar support adjacent to said top, into which at least a portion of the article may be inserted, the container being movably connected to said planar support so as to be movable between a display position and a utility position, the container when in its display position being arranged in a downwardly facing orientation to locate an article inserted therein so as to depend downwardly from the support body when the support body is suspended from said support, the container when in its utility position depends beyond the lower edge of the planar support with said open top facing upwardly so as to define a storage container into which the article may be inserted for storage when not in use, a strap movably connected to said planar support, the strap co-operating with the housing to support an elongate article received in said housing when in its utility position.

2. A display hanger according to claim 1 wherein the planar support includes suspension means to permit the planar support to be suspended from an article of clothing.

3. A display hanger for an article, the hanger including a planar support body adapted for suspension from a support, a container having a hollow housing with sides, a bottom and an open top, the housing hingedly connected to said planar support adjacent to said top, into which at least a portion of the article may be inserted, the container being movably connected to said planar support so as to be movable between a display position and a utility position, the container when in its display position being arranged in a downwardly facing orientation to locate an article inserted therein so as to depend downwardly from the support body when the support body is suspended from said support, the container when in its utility position being supported by said support body in an upwardly facing orientation so as to define a storage container into which the article may be inserted for storage when not in use, and a suspension means to permit the planar support to be suspended from an article of clothing.

4. A display hanger for an article, the hanger including a planar support body adapted for suspension from a support, a container having a hollow housing with sides, a bottom and an open top, the housing hingedly connected to said planar support adjacent to said top, into which at least a portion of the article may be inserted, the container being movably connected to said planar support so as to be movable between a display position and a utility position, the container when in its display position being arranged in a downwardly facing orientation to locate an article inserted therein so as to depend downwardly from the support body when the support body is suspended from said support, the container when in its utility position depends beyond the lower edge of the planar support with said open top facing upwardly so as to define a storage container into which the article may be inserted for storage when not in use, a suspension means to permit the planar support to be suspended from an article of clothing.

5. A display hanger for an article, the hanger including a planar support body adapted for suspension from a support, a container having a hollow housing with sides, a bottom and an open top, the housing hingedly connected to said planar support adjacent to said top, into which at least a portion of the article may be inserted, the container being movably connected to said planar support so as to be movable between a display position and a utility position, the container when in its display position being arranged in a downwardly facing orientation to locate an article inserted therein so as to depend downwardly from the support body when the support body is suspended from said support, the container when it its utility position being supported by said support body in an upwardly facing orientation so as to define a storage container into which the article may be inserted for storage when not in use, said planar support includes a tongue, said housing being hingedly connected to said tongue, said tongue is located in an aperture formed in said planar support, said housing, on movement to its utility position, being passed through said aperture such that said housing adjacent to its open top is engaged with an edge of said aperture such that the bottom of the housing and said support define a stand for enabling the housing to be located on a flat surface with its open top facing upwardly.

* * * * *